United States Patent [19]

Varrial

[11] Patent Number: 4,541,138

[45] Date of Patent: Sep. 17, 1985

[54] GOLF CLUB HEAD CLEANING MACHINE

[76] Inventor: Ralph W. Varrial, 17044 159 Pl. SE., Renton, Wash. 98055

[21] Appl. No.: 625,736

[22] Filed: Jun. 28, 1984

[51] Int. Cl.[4] ..... A63B 57/00; A46B 13/02

[52] U.S. Cl. ..... 15/21 D; 15/88

[58] Field of Search ..... 15/21 D, 4, 40, 34, 15/39, 74, 77, 88

[56] References Cited

U.S. PATENT DOCUMENTS

| | | | |
|---|---|---|---|
| 2,220,102 | 11/1940 | Hamilton, Sr. | 15/40 X |
| 3,148,396 | 9/1964 | Smith | 15/21 D |
| 3,619,841 | 11/1971 | Russell et al. | 15/21 D |
| 3,872,534 | 3/1975 | Hoag | 15/21 D |
| 4,042,993 | 8/1977 | Cervin | 15/21 D |

*Primary Examiner*—Edward L. Roberts

*Attorney, Agent, or Firm*—Robert W. Jenny; Robert W. Jenny

[57] ABSTRACT

The golf club head cleaning machine uses two pairs of cylindrical brushes, one pair for the irons, the other for woods. The brushes of each pair operate in close proximity and the cleaning is done in the areas of proximity. In these areas the bristles of the brushes move in opposite directions in order to reduce the structural loads on the joints between the heads and clubs. The brushes for the woods are accessible through an opening in the lower front of the machine and operate dry. The brushes for the irons are wetted and are accessible through a curtained slot which lies essentially in a horizontal plane and extends across the front and part way back on each side of the machine. This slot allows the club heads to be moved through the passage from one side of the machine to the other and therefore allows for using a conveyor to move the clubs through the machine. The curtains in the opening and slot prevent escape of debris and the cleaning liquid. The brushes for the irons mounted one above the other, are parallel to each other and to the front of the machine and are in a plane which is at an angle to the essentially horizontal plane of the passage such that the upper brush is closer to the back of the machine. The preferred angle is approximately 60 degrees. The brushes for the woods are also parallel to each other and to the front of the machine and are in a plane which is about 10 degrees out of vertical with the upper brush farther from the back of the machine.

6 Claims, 8 Drawing Figures

FIG. 4
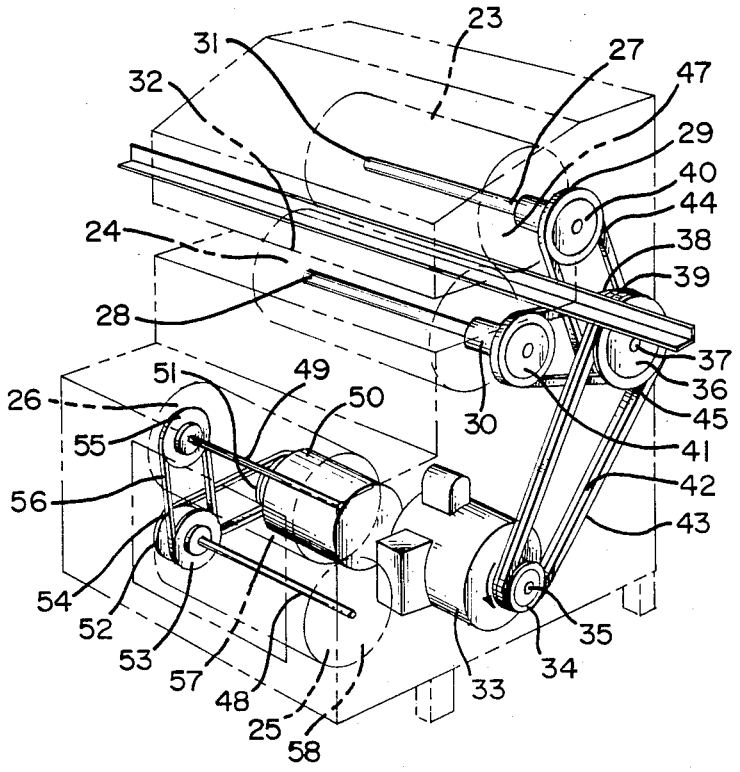
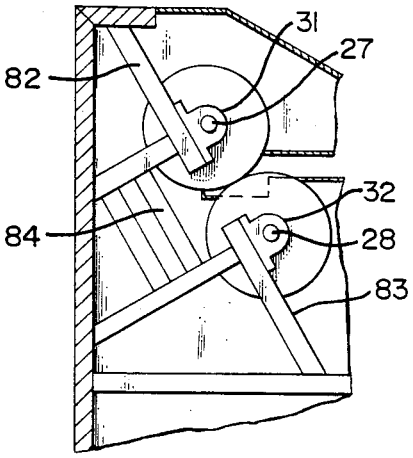
FIG. 5

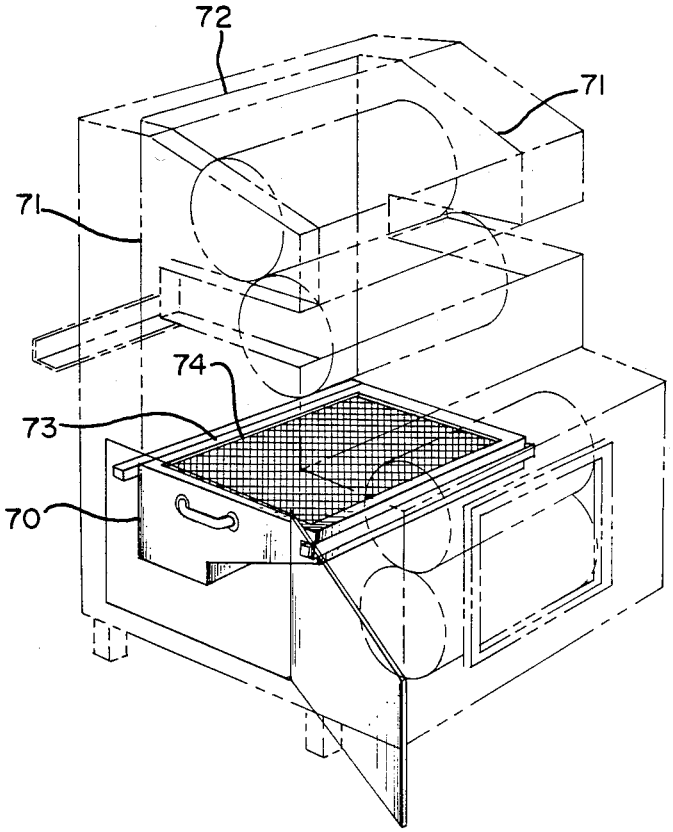
FIG. 6
FIG. 6A
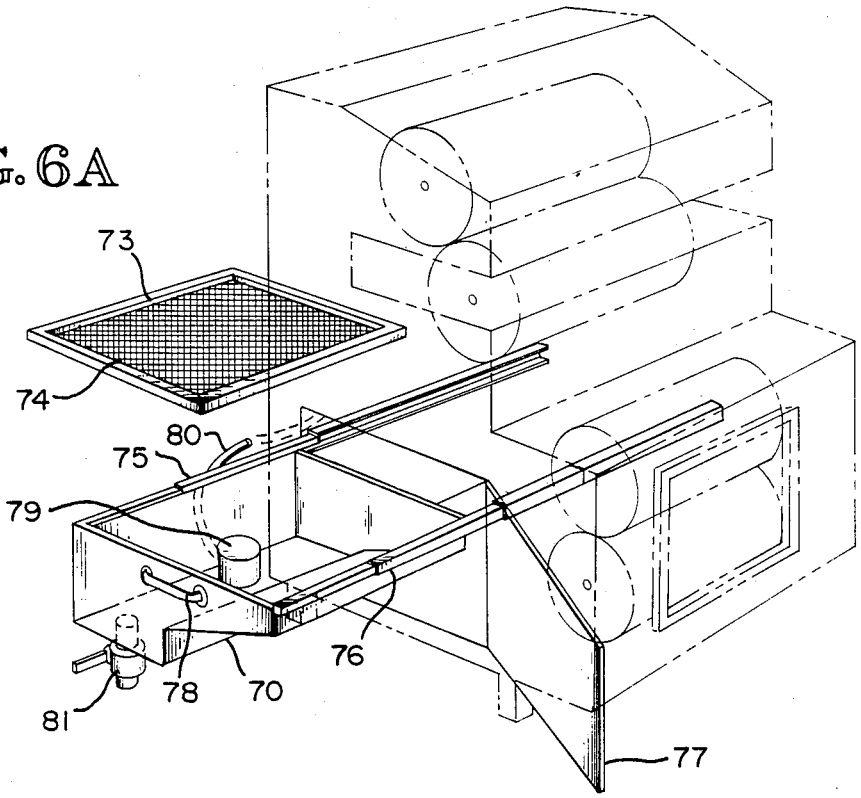

GOLF CLUB HEAD CLEANING MACHINE

BACKGROUND OF THE INVENTION

1. Field of the Art

The subject machine is in the general field of automatic washing machines, automatic machines for washing motor vehicles being a most common example. More specifically, however, it is in the field of apparatus for washing hand-held objects, such as drinking glasses, dishes and cooking utensils. Still more specifically it is in the field of apparatus for cleaning the heads of golf clubs.

2. Prior Art

A preliminary search of the prior art in this particular field shows that the problems with hand cleaning of club heads have been recognized for years, as evidenced by the following list of U.S. Patents, all relating to golf club head cleaning machines and similar apparatus. All the machines use power driven rotary brushes, singly or in cooperating pairs along with cleaning solutions and the apparatus needed for applying, retrieving, cleaning it etc.

U.S. Pat. No. 3,872,534
U.S. Pat. No. 3,648,315
U.S. Pat. No. 3,619,841
U.S. Pat. No. 3,332,099
U.S. Pat. No. 3,148,396

In spite of the long recognized problem and the known efforts to solve it, there is no known commercially successful machine for cleaning the heads of golf clubs. Such washing is almost universally done by hand, even though apparatus such as that shown in U.S. Pat. Nos. 3,619,841 and 3,872,534 has been known for some time. It must be concluded that for some combination of reasons the patented apparatus has been found not competitive with hand washing. It is believed that the primary reasons include a requirement for development of special techniques and skills in using the apparatus in order to get satisfactory results and, even with skillful use of proper techniques, the time required per club and the costs of operation, including maintenance costs, proved to be higher than expected, with the result that the apparatus has not found common usage.

Therefore, a first objective of the subject invention was the provision of golf club head cleaning apparatus capable of using simple, relatively self evident techniques; that is, without requirement for special and time consuming techniques to achieve satisfactory results. Further, a further objective was the apparatus be economical to make, use and maintain compared to prior art apparatus. As is well known in the art, two of the keys to economical manufacture, usage and maintenance are simplicity and durability of the apparatus by virtue of its basic design.

A further objective was that the operation not result in degradation of the golf clubs, taking into account the more recent manufacture and assembly features of golf clubs, notably the practice of using a close fit between the head and shaft along with bonding to attach the head to the shaft of the club, rather than using rivets, pins and the like. In more detail, this objective involves minimizing heating of and/or loads applied at the attachment of the head to the shaft.

Another objective was to provide the capability to accomodate left handed as well as right handed clubs, as well as to specifically allow for the unique differences between woods and irons. Still another objective was that the apparatus be self contained to the extent that dirt and debris removed from the clubs and the cleaning fluids used do not soil or contaminate the user or the immediate environment of the apparatus.

Still another important objective of the invention was that it be efficient in terms of the time and effort required per head cleaned.

The following Summary Of The Invention, the Detailed Description Of The Invention and the related Drawings describe a preferred embodiment of the invention and how it meets the stated objectives.

SUMMARY OF THE INVENTION

The subject invention comprises a sound proofed cabinet containing two pairs of power driven cylindrical brushes, one pair for cleaning irons, the other for cleaning woods. The brushes for the irons are located in the upper portion of the cabinet, about chest high. The brushes for the woods are in the lower portion, about knee high. All the brushes are power driven on horizontal shafts and all rotate in the same direction. The brushes of each pair barely touch each other at their peripheries. For cleaning, the heads are positioned as described in more detail later, between the brushes where the brushes are in closest proximity to each other; i.e. in the area of proximity of the brushes. In this position and with the brushes rotating in the same direction, the peripheries are moving in opposite directions at their points of contact with the face and back of each club head. The purpose for this is to minimize the forces imposed on the joints between the heads and shafts of the clubs.

Describing the brush apparatus for the woods in more detail, the shafts of this pair of brushes are parallel to each other and to the front of the cabinet and they are in a plane tilted at an angle approximately 10° from vertical with the upper brush closer to the front of the cabinet. The front surface of the cabinet in this area is parallel to the plane of the brush shafts. The upper brush is relatively soft with nylon bristles. The lower brush is stiffer and has crinkled polypropylene bristles. Access to the brushes is through a rectangular opening or passageway in the front surface of the cabinet. The edges of the opening are fitted with elastomeric bumper strips. The debris is caught in a removable bin at the bottom of the cabinet. These brushes are in an enclosure which is padded. The enclosure ensures that the club head remains in the area of proximity of the brushes and the padding prevents any damage to the club heads. The direction of rotation of the brushes is such that the bristles of the stiffer, lower brush move "away" from the front of the machine and tend to pull the club head into the machine.

In operation the head of a wood club is inserted through the opening with the metallic face down to be cleaned by the stiffer, lower brush. The wood surfaces are cleaned by the softer nylon brush. The club is positioned so that any grooves in the metallic surface will be essentially parallel to the direction of motion of the bristles. This means that the shafts of right handled clubs will be angled to the left of a person standing before the cabinet and vice versa for left handed clubs. The club position is manipulated in and out, past the tangential contact area of the brushes, and angularly, up and down and from side to side, to assure complete contact between the brushes and the surfaces to be cleaned. After a short time the club is removed and examined and the process is repeated if necessary.

Describing the apparatus for cleaning irons in more detail, the axes of the cylindrical brushes are parallel to the front of the cabinet and to each other and lie in a plane slanted approximately 30° from vertical away from the front of the cabinet. This orientation of the brushes maximizes the effectiveness of the bristles in cleaning the heads and minimizes the heating of the joint between the head and shaft. Access to these brushes is through an opening which extends completely across the front of the cabinet and part of the way across each of the sides, forming a passageway through the machine from side to side and open to the front. The lower edge of the opening lies in a horizontal plane which is essentially tangential to the top of the lower brush. The opening is closed off by elastomeric curtains which allow passage of the golf clubs as described below but prevent escape of debris cleaned from the clubs or of the cleaning fluids. The brushes are enclosed in a compartment inside the cabinet and the cleaning fluid is held in a sump which forms the lower portion of the compartment. The sump itself is separated from the rest of the compartment by a filter in a horizontal plane below the lower brush. This filter separates all but the smallest particles of debris, etc., from the cleaning fluid. A pump in the sump supplies the fluid to nozzles which are directed into the brushes. The filter and sump slide out of the side of the cabinet through a door for cleaning, servicing, refilling, etc.

The procedure for cleaning the head of an iron is as follows: Before the club is inserted into the cleaner the club is positioned so that its shaft essentially is in the horizontal plane of the lower edge of the opening and also so that the head of the club is in a plane perpendicular to the plane of the roller shafts and midway between them and also so that any grooves in the faces of the head are essentially aligned with the direction of motion of the brush bristles. The club is then moved into the side of the cabinet and "across" the cabinet so that it passes along the length of the brushes and out the other side of the cabinet being cleaned as it passes through. There are means included to facilitate this process and the means are an important part of this invention. The means include a guide and a work surface. The guide is parallel to the shafts of the brushes. It passes through the cabinet from side to side and extends beyond each side. The guide has a right angle crossection with one leg horizontal and extending toward the front of the machine and the other vertical and extending upward. Further, the guide is positioned in back of the brushes and so that the extremities of its "legs" are just in contact with the peripheries of the brushes, the vertical leg near the upper brush.

The work surface is horizontal and in the plane of the lower edge of the opening and extends out from the front and sides of the machine. To clean a club head using these means, the tip of the head is positioned in the guide, the shaft is laid against the work surface and angled about 60° to the general plane of the front of the cabinet. The club is moved across the work surface and through the machine. There may be demarcations on the work surface to assist in proper positioning of the shafts. Right handed clubs move from left to right and vice versa, with the head going first.

To further facilitate the operation, the work surface may be a conveyor having apparatus for holding the clubs in the correct orientation and moving them through the machine. With this apparatus club heads are cleaned by inserting the club shafts into the appropriate fittings on the conveyor with the head resting in the guide and then, by conveyor action, moving the club through the machine. The apparatus includes means for removing the clubs with cleaned heads from the conveyor and holding them for retrieval by the user.

Clubs may be inserted for cleaning one at a time with the conveyor in motion or a number of clubs may be inserted with the conveyor stopped for the insertion and then switched on for the cleaning.

The entire machine is powered by switch controlled electric motors. It is feasible to use coin operated switches when circumstances so dictate.

It is considered that the differences between the apparatus and techniques for cleaning the heads of woods and those for cleaning the heads of irons make it clean the objectives of this invention could not be met without the use of two distinct sets of brushes.

The invention and its features are explained in more detail by the drawings and the following detailed description of the invention.

BRIEF DESCRIPTION OF THE DRAWINGS

FIG. 4 is a perspective schematic of the basic mechanism of the machine.

FIG. 5 shows details of the structural support for the bushes for cleaning irons.

FIG. 6 shows the machine in phantom except for the apparatus for the cleaning fluid for the irons and the door providing access to the apparatus.

FIG. 6A shows the machine in phantom except for the apparatus for the cleaning fluid for the irons, with the apparatus positioned for maintenance and showing details additional to those of FIG. 6.

DETAILED DESCRIPTION OF THE INVENTION

The detailed description of the subject invention is partly schematic. Any details not illustrated and described in detail are considered to be well within the design and construction capabilities of people having ordinary skill in the art.

In the subject embodiment the invention comprises a structural frame, shown in part in FIG. 5, enclosed by panels and doors and, in areas providing access for cleaning th golf club heads, elastomeric flap apparatus. The structure and the apparatus supported by it are entirely enclosed to prevent soiling and contamination of the operator(s) and immediate environment of the machine.

Figure 1:
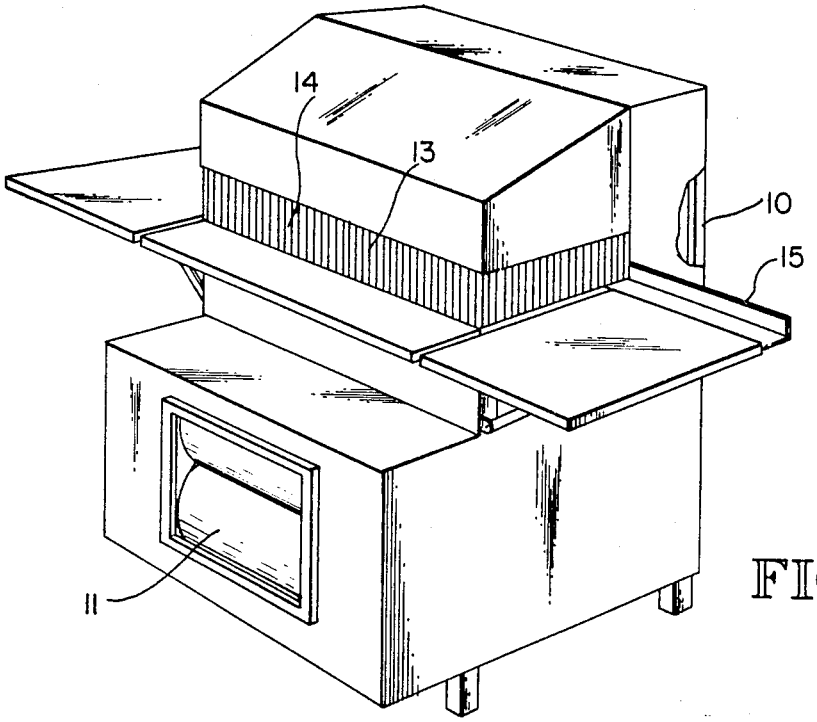
FIG. 1 is a perspective view of the basic machine.

FIG. 1 is an illustration of the basic machine 10. Rectangular passageway 11 in the lower front portion of the machine provides access to the apparatus for cleaning the golf clubs known as woods. The heads of the clubs can be inserted into and removed from the machine for cleaning and debris removed from the clubs is caught in a tray or bin which is removeable.

Access for cleaning the heads of the clubs known as irons is provided by slot 13 which extends entirely across the front of the machine and partway across each side. This access is closed off by elastomeric curtains 14, and others not visible in this view. Some of the curtains are double, with the space between them about equal to the dimensions of the golf club heads so that as the head is passed through the curtained opening, both curtains cannot be parted at the same time by passage of the head.

Figure 2:
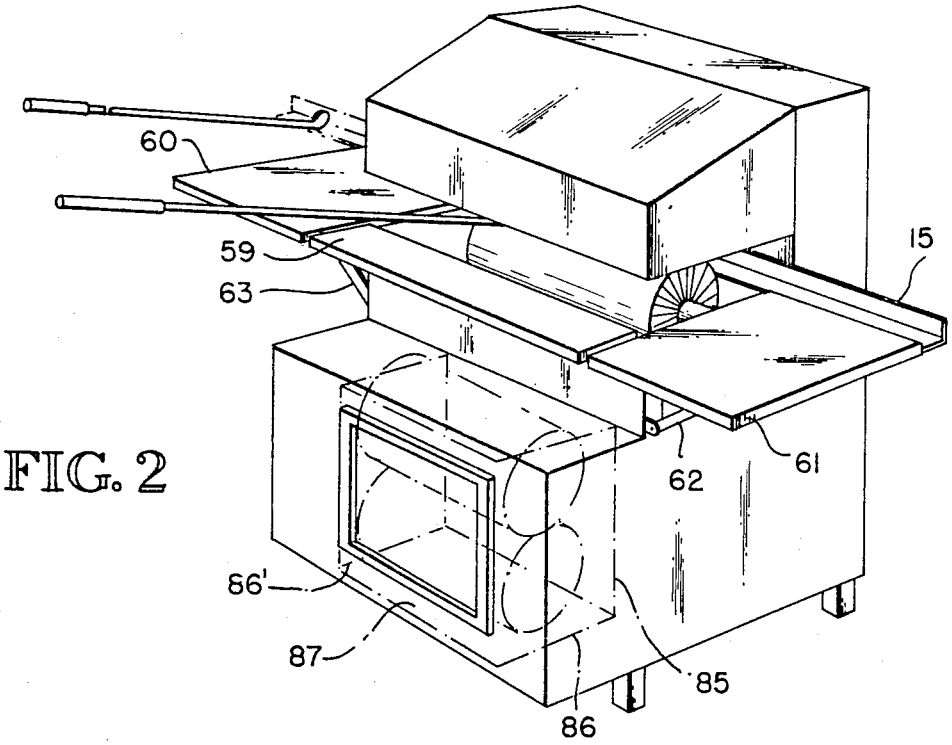
FIG. 2 is a perspective view of the basic machine with the protective curtains removed from the opening for passing golf clubs known as irons through the machine. Also shown are the padded shields and tray associated with the lower pair of brushes.

Part 15 is a guide, the details and function of which are described later. FIG. 2, a view identical to FIG. 1 except for the removal of the curtains 14 from slot 13, shows the guide 15 extending completely through the machine from side to side and partly obscured by the cylindrical brushes which clean the heads and which are also described in more detail later. The implementation shown in FIGS. 1 and 2 is for manual operation of the machine, one club at a time, using techniques described later.

Figure 3:
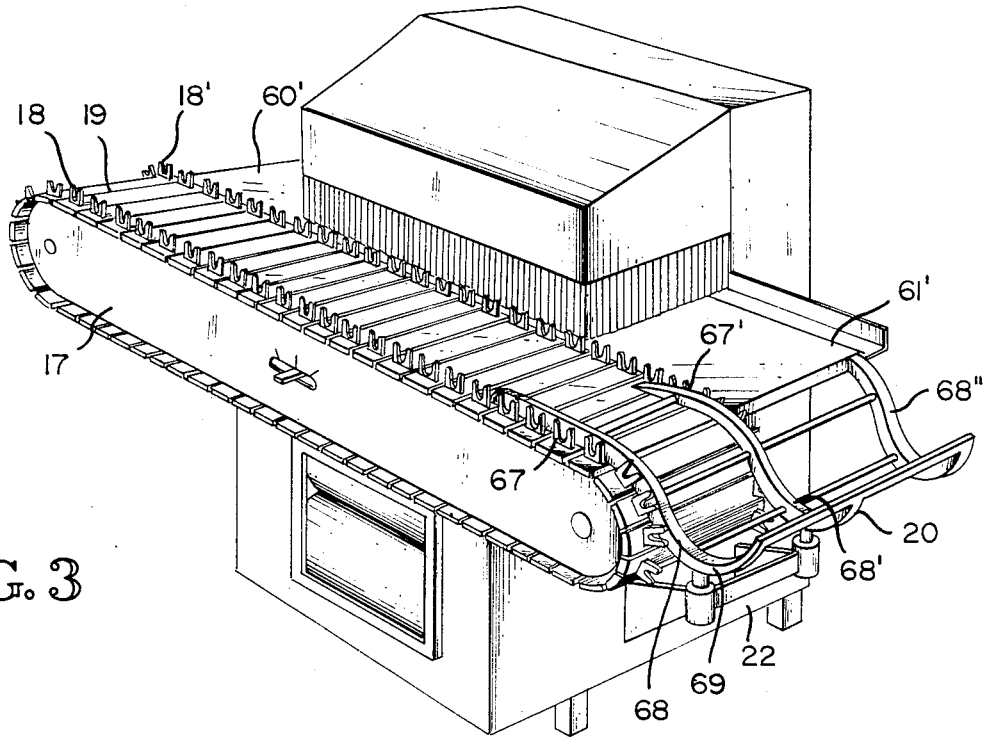
FIG. 3 is a perspective view of the machine with a conveyor apparatus for the "irons".

In FIG. 3 the machine is fitted with conveyor means 17. The conveyor means further comprises fixtures 18 and 18' on each conveyor segment 19 for holding clubs in the proper orientation and moving them through the machine for cleaning. Clubs to be cleaned are inserted into appropriate fixtures 18 and 18' moved through the machine, removed from the conveyor by fixture 20 and held in fixture 20 for removal by the user. As will be explained in more detail later, right handed clubs are set into the holding means on the conveyor at the left and moved to the right, through the machine, to be deposited cleaned in fixture 20. For left handed clubs the motion of the conveyor is reversed and the clubs move from right to left.

The conveyor is a self contained unit attachable to and removable from the basic machine using means well known in the art. The drive motor for the conveyor is totally enclosed in the unit and controlled by three-position switch 21. The mid-position is off. Moving the switch to the right runs the conveyor toward the right for right handed clubs. Moving it to the left runs the conveyor to the left for left handed clubs.

Fixture 20 is demountably supported by bracket 22 and is demounted when left handed clubs are to be cleaned. A similar but opposite handed fixture is mounted at the left hand end of the conveyor to remove and receive the cleaned left handed clubs.

The primary apparatus is shown in FIG. 4. It comprises cylindrical brushes 23 and 24 for cleaning the irons and 25 and 26 for cleaning the woods. Brush 23 is mounted on shaft 24 and brush 24 on shaft 28. Shafts 27 and 28 are located so that the peripheries of the brushes are close but not in contact with each other. The shafts are mounted in bearings in pillow blocks 29, 30, 31 and 32 at the ends of the brushes. (See FIG. 5 for 31 and 32) The brushes are driven by electric motor 33, attached to structure in the base of the machine, and a system of pulleys and belts. The system comprises pulley 34 on shaft 35 of motor 33, pulley 36 on countershaft 37, pulleys 38 and 39 also on counter shaft 37, and pulleys 40 and 41 on shafts 27 and 28 respectively. The pulleys accommodate V belts and pulleys 34 and 36 are double groove. Countershaft 37 is attached to the machine structure by means for adjusting its location to adjust the tension in all the belts.

Belts 42 and 43 deliver power from the motor to the countershaft and belts 44 and 45 from the countershaft to brushes 23 and 24 respectively via shafts 27 and 28.

All the shafts rotate in the same direction as the motor shaft and the peripheries of the brushes at their points of closest proximity (the area of proximity) are therefore moving in opposite directions as indicated by arrows 46 and 47 counterclockwise rotation of the motor shaft. This relative motion of the bristles reduces loads applied to the joints between shafts and heads of the clubs on which heads are being cleaned.

Brushes 25 and 26 are mounted on shafts 48 and 49 respectively and the shafts are mounted in bearings in pillow blocks (not shown) attached to the machine structure. The shafts are located so that the peripheries of the brushes at their closest proximity (in the area of proximity) are close but not in contact. These brushes are driven by electric motor 50, mounted on base structure of the machine, and a system of pulleys and belts. Pulley 51 on the shaft of motor 50 drives pulley 52 on shaft 48 and also pulley 53, via shaft 48, by belt 54. Pulley 55 and shaft 49 are driven from pulley 53 by belt 56. In this system also all shafts rotate in the same direction and the peripheries of the brushes, at their areas of closest proximity, are moving in opposite directions as indicated by arrows 57 and 58 for counterclockwise rotation of the shaft of motor 50.

Shafts 27 and 28 are in a plane slanted approximately 30° out of vertical, with shaft 27 farther away from the front of the cabinet than shaft 28. This positioning best accommodates the heads of the golf clubs when they are inserted for cleaning in the manner explained later. As mentioned previously, it also helps to maximize the cleaning effects of the bristles while minimizing heating of the joint between the head and shaft of the club. Also, shafts 48 and 49 are in a plane which is slanted about 10° out of vertical with shaft 49 closer to the front of the machine than shaft 48. This 10 degree orientation has the same benefits for the woods as the 30 degree orientation of the brushes for the irons does for the irons.

Brushes 23 and 24 are about 8 inches in diameter and 18 inches long. Each brush is spiral wound on a 2 inch diameter tube with fittings at each end to accommodate shafts of about $\frac{3}{4}''$ diameter. The bristles are 0.030 diameter, crinkly, and made of polypropylene.

Brush 26 is about 8 inches in diameter and 10 inches long. There are 18 winds of bristles per foot on a 2 inch diameter tube with fittings at each end to accommodate a $\frac{5}{8}''$ diameter shaft. The bristles are nylon, 0.008 inches in diameter.

Brush 25 is the same as brush 26 except that its bristles are polypropylene, 0.022 inches in diameter, and crinkly.

The brushes are available from the Richards Brush Company, 3229 Airport Way South, Seattle, Wa., 98124.

The basic operation of the machine for cleaning the head of an iron is described with reference to FIG. 2. The club is held with its head resting on the guide (shown extended in phantom lines for clarity) with the broader faces of the head essentially in a plane that is commonly tangential to both the cylindrical peripheries of the brushes and with the longest dimension of the head essentially aligned with the directions of bristle motions. The common tangential plane is parallel to the axis of the brushes and slopes upward and forward from the guide at about a 30° angle from horizontal. With the head aligned as described, the handle will lie essentially in a horizontal plane with the shaft at a 60° angle from perpendicular to the front plane of the machine. With the club positioned as described, it is then moved along the guide, through the passageway through the machine at the pace of a slow walk. Experience indicates that one such pass will satisfactorily clean the head of clubs exposed to all but exceptional use conditions. It may be necessary in some instances to move the head from front to back of the horizontal surface of the guide as the head moves past the brushes. It may also be useful to raise and lower the club handle slightly to assist the cleaning process. The guide is normally shaped or fitted with attachments to cause the front to back motion but may be rectilinear.

Support and positioning of the clubs is assisted by table 59, 60 and 61. Table 59 extends the width of the machine and is flush with the lower edge of slot 13. Tables 60 and 61 extend from guide 15 to the front edge of table 59. They are mounted on commercially available folding hinges, two of which can be seen in the figure, hinges 62 and 63. The brackets enable folding the tables downward, flat against the sides of the machine. The lateral dimension of the table is such that table 60, when folded down, does not interfere with the access door on the left side of the machine, which is described later.

When the conveyor is used, table 59 is removed and alternate tables 60' and 61' are installed. The alternate tables extend from guide 15 to the edge of the conveyor, as indicated in FIG. 3.

Figure 3A:
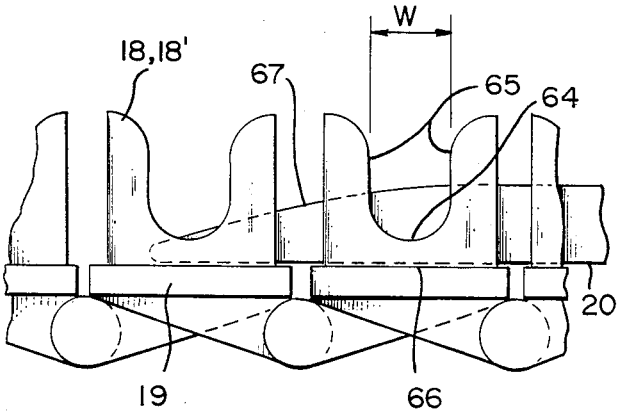
FIG. 3A is a detailed view looking at the edge of the conveyor belt and illustrating the fixtures which hold the clubs on the conveyor.

FIG. 3A shows in more detail fixtures 18 and 18' on conveyor segments 19. A suitable conveyor is manufactured by Dyna-vector, Inc., P. O. Box 96, Cranford, N.J. 07016. The segments are cast plastic and the fixtures are attached by any suitable means well known in the art, such as threaded fastenings, adhesives or combinations.

As indicated, the fixtures are essentially V-shaped. The dimension W is such that the club shafts will fit through at a 60° angle to the plane of the fixture. The bottom 64 of slot 65 in each fixture is a distance from surface 66 of segment 19 sufficient to allow ends 67 and 67' of fixture 20 to pass under the club shafts held in fixtures 18 and 18'. The height of the fixtures is such that they continue to engage the shafts and move the clubs along fixture 20 to sloped portions 68, 68' and 68''. The shafts are disengaged from the fixtures as the fixtures move around the end of the conveyor and the clubs slide into the cradle portion 69 of fixture 20.

The cleaning of the heads of "irons" is augmented by the use of liquid such as water with detergent added. The liquid is sprayed into the revolving brushes in appropriate directions, locations and amounts, all determinable by persons of ordinary skill in the art. The liquid is stored in reservoir 70 in FIGS. 6 and 6A. The reservoir forms the bottom of an enclosure around the brushes for the irons. This enclosure is inside the cabinet of the machine and comprises the front and top walls of the cabinet and shields at the ends of and behind the brushes. The shields are shown in phantom in FIG. 6. Shields 71 and 71' are the end shields. Shield 72 is behind the brushes. The lower ends of the shields are close to the rim 73 of filter 74 and elastomeric seals, not shown, seal the gaps to prevent leakage of the liquid. Filter 74 keeps all but the smaller particles of debris cleaned from the club heads from contaminating the liquid.

Reservoir 70 is mounted on telescopic slides 75 and 76 and is made accessible for maintenance service by opening door 77, and moving it out as shown in FIG. 6. Handle 78 is provided for this purpose. In operation, the reservoir is partly filled with the liquid and the liquid is pumped by sump pump 79 through flexible hose 80 to the nozzles for spraying the liquid onto the brushes and club heads. The pump is electrically driven and is switched on whenever the motor driving the brushes is switched on. Valve 81 is provided for draining the liquid when it is necessary to replace the liquid.

As noted above, a key feature of the subject machine is that the operation can be conveyorized and one feature that enables this is the structure on which the bearing supporting the rollers are mounted. This structure, part of the frame of the machine, is shown in FIG. 5. Pillow blocks, 31 and 32, for shafts 27 and 28 respectively, are attached to members 82 and 83 respectively. The space between the ends of members 82 and 83 and member 84 allows passage of the club heads and guide 15 through the machine from side to side.

The cleaning of the woods is done with dry brushes. The height of opening 11 from the floor and the orientation of the shafts of brushes 25 and 26 are such that the proper cleaning action is provided when the club head is inserted with its metal face essentially horizontal and facing downward and the slots or grooves in the face aligned with the direction of motion of the bristles. The working surface of the lower, stiffer brush moves "into" the machine and tends to draw the head into the machine. This motion, as well as motion from side to side is limited by padded walls 85, 86 and 86' shown in phantom in FIG. 2. The cleaning action may be augmented by lifting the head into the softer, upper brush and by rotating the head to expose all of the wooden surface to the direct action of the brush. Tray 87, beneath the lower edges of walls 85, 86 and 86' (also in phantom in FIG. 2) catches the debris removed from the heads. The tray is mounted in rails and slides out for emptying and cleaning. These detailed descriptions of the apparatus and techniques for cleaning the heads of irons and the heads of woods add further substantiation for the use of two distinct and different sets of brushes in order for the invention to meet its objectives.

It is considered clear from this disclosure that the subject invention meets the stated objectives. The design is simple and the machine is accordingly simple and durable. It is easy to use and requires a minimum of learning for satisfactory use by people of ordinary skill. This characteristic is particularly enhanced by the design features which allow cleaning a club head by passing it through the machine from side-to-side with the assistance of a guide. These same features enable further improvement in economic efficiency by the use of a conveyor attachment for speeding up the operation and requiring less operator time per club cleaned. In prior art machines it was necessary to insert and remove the club heads from the same opening with associated hazards to the structural integrity of the clubs, particularly the attachment of the heads to the shafts. The subject machine puts only minimum loads on this joint because of the pass-through features and the opposing directions of motion of the bristles in contact with the head and shaft near the head. The minimization of the loading is substantially augmented by the orientation of the plane of the axes of the brushes 30 degrees out of vertical for the irons and 10 degrees out of vertical for the woods. The machine cleans both left hand and right hand clubs with equal facility. It contains all cleaning liquid and removed debris and the debris is readily removeable via a service door and a removeable filter tray. In summary, the machine provides economically feasible means for cleaning the heads of golf clubs with a minimum of manual labor.

A preferred embodiment of the invention is disclosed herein. It will be obvious to those skilled in the art that the invention may be embodied in other ways and/or with modifications of the subject embodiment. Therefore the scope of the invention is defined and limited only by the attached claims.

What is claimed is:

1. A golf club head cleaning machine comprising:

a cabinet having a back, a first side, a front, a second side and a slot comprising a first side portion in said first side, a front portion in said front and a second side portion in said second side whereby a passage is provided through said cabinet from side to side and open across said front, said passage being oriented essentially in a horizontal plane, a first upper brush having a first cylindrical shape, bristles, a periphery and a first axis of said first cylindrical shape, a second lower brush having a second cylindrical shape, bristles, a periphery and a second axis of said second cylindrical shape, means for rotatably mounting said first and second brushes for rotation about said first and second axes with said axes:

(a) parallel to each other.

(b) essentially parallel to said front, (c) lying in a first plane which is at an angle with said horizontal plane such that said first upper brush is closer to said back than said second lower brush, (d) said angle being in the range of 50 degrees to 70 degrees, means for rotatably mounting said first and second brushes for rotation of each about each of said axes with said axes parallel to each other and essentially parallel to said front and so that there is a first area of close proximity of said peripheries and so that said area is in said passage and, means for rotating said brushes about said axes with said bristles of said first brush moving through said front area of close proximity in a first direction and said bristles of said second brush moving through said first area of close proximity in a second direction, opposite to said first direction, whereby a golf club head moved through said passage from side to side of said machine passes through said first area of close proximity and is exposed to cleaning action by said bristles.

2. The machine of claim 1, further coomprising:

a third brush having a third cylindrical shape, an axis of said third cylindrical shape, a periphery and bristles, a fourth brush having a fourth cylindrical shape, an axis of said fourth cylindrical shape, a periphery and bristles, means for mounting said third and fourth brushes for rotation of each about each of said axes with said axes parallel to each other and essentially parallel to said front and so that there is a second area of close proximity of said peripheries and said third brush is above said fourth brush, an opening in said cabinet providing a passageway for inserting a golf club head into said second area of proximity, means for rotating said brushes about said axes with said bristles of said third brush moving through said second area of proximity in a third direction and said bristles of said fourth brush moving through said second area of proximity in a fourth direction, opposite to said third direction and away from said front.

3. The machine of claim 2 in which said angle is in the range of 59 degrees to 61 degrees.

4. The machine of claim 3 in which said axis of said third cylindrical shape and said axis of said fourth cylindrical shape are in a second plane, said second plane being out of vertical by an angle in the range of 8 degrees to 12 degrees, said second plane sloping so that said third brush is farther from said back than said fourth brush.

5. The machine of claim 2 in which said axis of said third cylindrical shape and said axis of said fourth cylindrical shape are in a second plane, said second plane being out of vertical by an angle in the range of 8 degrees to 12 degrees, said second plane sloping so that said third brush is farther from said back than said fourth brush.

6. The machine of claim 1 in which said angle is in the range of 59 degrees to 61 degrees.

* * * * *